US011560752B1

(12) United States Patent
Fernandez

(10) Patent No.: US 11,560,752 B1
(45) **Date of Patent: *Jan. 24, 2023**

(54) PET DOOR AND DETACHABLE WINDOW SYSTEMS

(71) Applicant: Ricardo Fernandez, Tempe, AZ (US)

(72) Inventor: Ricardo Fernandez, Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/214,807

(22) Filed: Mar. 27, 2021

Related U.S. Application Data

(63) Continuation of application No. 15/973,121, filed on May 7, 2018, now Pat. No. 10,961,770, which is a continuation-in-part of application No. 15/205,902, filed on Jul. 8, 2016, now abandoned.

(51) Int. Cl.
*E06B 7/32* (2006.01)
*E06B 3/70* (2006.01)
*E05D 11/10* (2006.01)

(52) U.S. Cl.
CPC ..... *E06B 7/32* (2013.01); *E05D 11/1007* (2013.01); *E06B 3/70* (2013.01); *E05Y 2900/132* (2013.01); *E06B 2003/7046* (2013.01); *E06B 2003/7049* (2013.01); *E06B 2003/7057* (2013.01)

(58) Field of Classification Search
CPC ..... E06B 7/32; E06B 2003/7057; E05C 9/14; E05C 9/10; E05D 11/1014; E05B 15/0205
See application file for complete search history.

(56) References Cited

U.S. PATENT DOCUMENTS

| | | | | |
|---|---|---|---|---|
| 1,204,833 | A | 11/1916 | Warfel | |
| 2,779,401 | A * | 1/1957 | Bascom | E06B 5/003 49/63 |
| 2,790,414 | A | 4/1957 | Rossow | |
| 3,060,525 | A | 10/1962 | Migneault et al. | |
| 3,464,158 | A | 9/1969 | Greene | |
| 3,738,322 | A | 6/1973 | Smith | |
| 3,878,645 | A | 4/1975 | Porter | |
| 3,918,203 | A | 11/1975 | Ellison, Jr. | |
| 4,047,331 | A | 9/1977 | Davlantes | |
| 4,053,007 | A | 10/1977 | Griffith | |
| 4,103,458 | A | 8/1978 | Booker | |
| 4,322,913 | A | 4/1982 | Himmer | |
| 4,738,053 | A | 4/1988 | Biesenthal | |
| 4,760,872 | A | 8/1988 | Hale, Jr. | |
| 4,908,978 | A | 3/1990 | Zacharias | |
| 5,117,890 | A | 6/1992 | Taylor et al. | |
| 5,269,097 | A | 12/1993 | Davlantes | |
| 5,581,940 | A | 12/1996 | Peterson | |

(Continued)

FOREIGN PATENT DOCUMENTS

DE 9420721.6 7/1995

*Primary Examiner* — Gregory J Strimbu
(74) *Attorney, Agent, or Firm* — IPTechLaw

(57) ABSTRACT

Implementations of detachable window systems may include: a main panel including one or more windows therein, the one or more windows in the main panel each having a window casing, a screen, and a window opening mechanism; an upper panel hingedly coupled to an upper side of the main panel; and a lower panel hingedly coupled to a lower side of the main panel opposing the upper side. The window opening mechanism on each of the one or more windows may be used to open the window to permit air to flow through the screen.

10 Claims, 12 Drawing Sheets

(56) References Cited

U.S. PATENT DOCUMENTS

| | | | | |
|---|---|---|---|---|
| 5,586,796 | A * | 12/1996 | Fraser | E05B 15/0205 292/357 |
| 5,735,079 | A | 4/1998 | Davlantes | |
| 5,927,011 | A | 7/1999 | Sickenius | |
| 5,946,855 | A | 9/1999 | Miconi | |
| 5,992,096 | A | 11/1999 | De La Cerda et al. | |
| 6,164,013 | A | 12/2000 | Ramsey | |
| 6,357,509 | B1 | 3/2002 | Lamazares | |
| 6,385,909 | B1 | 5/2002 | Marsh et al. | |
| 6,668,487 | B2 | 12/2003 | Vesey | |
| 7,063,123 | B2 | 6/2006 | Lethers | |
| 7,159,361 | B1 | 1/2007 | Hale, Jr. | |
| 7,913,454 | B2 | 3/2011 | Sullivan | |
| 8,176,962 | B2 | 5/2012 | Kilfoyle | |
| 8,333,037 | B2 | 12/2012 | Sullivan | |
| 8,434,264 | B2 | 5/2013 | Bosserdet, Jr. | |
| 8,484,896 | B1 | 7/2013 | Skubiak, Jr. | |
| 8,567,137 | B2 | 10/2013 | Sullivan | |
| 10,435,942 | B1 | 10/2019 | Dunavin | |
| 10,961,770 | B1 * | 3/2021 | Fernandez | E06B 9/02 |
| 11,274,491 | B1 * | 3/2022 | Fernandez | E06B 3/54 |
| 2002/0150434 | A1 | 10/2002 | Sommerfeld et al. | |
| 2005/0050833 | A1 | 3/2005 | Spray | |
| 2005/0284402 | A1 | 12/2005 | Becker | |
| 2006/0201638 | A1 | 9/2006 | Hesketh | |
| 2008/0168712 | A1 | 7/2008 | McDermott | |
| 2010/0282181 | A1 | 11/2010 | Turner | |
| 2011/0023365 | A1 | 2/2011 | Kilfoyle | |
| 2011/0047873 | A1 | 3/2011 | Kuhn et al. | |
| 2012/0304937 | A1 | 12/2012 | Matteson et al. | |

* cited by examiner

PET DOOR AND DETACHABLE WINDOW SYSTEMS

CROSS REFERENCE TO RELATED APPLICATIONS

This application is a continuation application of the earlier U.S. Utility patent application to Ricardo Fernandez entitled, "Pet Door and Detachable Window Systems," application Ser. No. 15/973,121, filed May 7, 2018, issued as U.S. Pat. No. 10,961,770, which was a continuation-in-part application of the earlier U.S. Utility patent application to Ricardo Fernandez entitled "Pet Door Systems," application Ser. No. 15/205,902, filed Jul. 8, 2016, now abandoned, the disclosure of which is hereby incorporated entirely herein by reference.

BACKGROUND

1. Technical Field

Aspects of this document relate generally to pet doors and detachable window system, such as systems for allowing pets to enter a home or other structure.

2. Background

Pet doors are used to allow animals, such as dogs or cats, to enter a home or other structure through an opening sized to receive them. An example of a conventional pet doors can be found in U.S. Pat. No. 3,878,645 to Robert C. Porter, issued Apr. 22, 1975, entitled "Pet Door Device," (the '645 patent) the disclosure of which is hereby incorporated entirely herein by reference.

SUMMARY

Implementations of detachable window systems may include: a main panel including one or more windows therein, the one or more windows in the main panel each having a window casing, a screen, and a window opening mechanism; an upper panel hingedly coupled to an upper side of the main panel; and a lower panel hingedly coupled to a lower side of the main panel opposing the upper side. The window opening mechanism on each of the one or more windows may be used to open the window to permit air to flow through the screen.

Implementations of detachable window systems may include one, all, or any of the following:

The main panel may be configured to couple with a deadbolt strike plate of a door casing and to couple with a deadbolt or a door latch of a door hung within the door casing.

The upper panel may be hingedly coupled to the main panel through a locking hinge and the lower panel may be hingedly coupled to the main panel through a locking hinge.

The upper panel may be biased upwardly through a toggle latch coupled to the main panel.

The main panel may further include a deadbolt coupling system including a deadbolt bar coupled to a mounting plate.

The mounting plate, when mounted to an edge of the main panel opposing an edge to which a door is coupled, may position the deadbolt bar substantially perpendicular with a plane formed by the upper panel.

The deadbolt coupling system may include a deadbolt bar and the deadbolt bar may rest within an opening of a deadbolt strike plate of a door casing when the upper panel is installed between the door casing and a door hung within the door casing.

The main panel may further include a deadbolt strike plate, a door latch strike plate, or both a deadbolt strike plate and a door latch strike plate.

The deadbolt strike plate, door latch strike, or deadbolt strike plate and door latch strike plate may be configured to engage with a deadbolt or a door latch of a door hung within a door casing to which the main panel is coupled.

The system may further include a door stop coupled along a side of the main panel where the door stop includes the deadbolt strike plate, the door latch strike plate, or the deadbolt strike plate and door latch strike plate.

The system may further include a locking system including a toggle latch coupled along a side of the main panel and a hook, the hook having a first curved end and a second curved end. The first curved end of the hook may be coupled with a door knob of a door hung within a door casing and the second curved end of the hook may be coupled with a ring extending from the toggle latch.

The system may not include a pet door in the main panel.

Implementations of detachable window systems may include a main panel including one or more openable windows therein, an upper panel hingedly coupled to an upper side of the main panel, and a lower panel hingedly coupled to a lower side of the main panel opposing the upper side. The system may also include a door stop coupled along a side of the main panel where the door stop includes a deadbolt strike plate, a door latch strike plate, or both a deadbolt strike plate and a door latch strike plate. A deadbolt coupling system may be included, coupled on a side of the main panel opposing the side of the main panel to which the door stop is coupled. The deadbolt coupling system may include a deadbolt bar mounted to a mounting plate.

Implementations of detachable window systems may include one, all, or any of the following:

The deadbolt coupling system may be configured to couple with a deadbolt strike plate of a door casing. The deadbolt strike plate, door latch strike plate, or the deadbolt strike plate and door latch strike plate may be configured to couple with a deadbolt, a door latch, or both a deadbolt and door latch of a door hung within the door casing.

The upper panel may be hingedly coupled to the main panel through a locking hinge and the lower panel may be hingedly coupled to the main panel through a locking hinge.

The upper panel may be biased upwardly through a toggle latch coupled to the main panel.

The one or more openable windows may each include a window casing, a screen, and a window opening mechanism to open the window.

The window opening mechanism on each of the one or more windows may be used to open the window to permit air to flow through the screen.

The system may not include a pet door in the main panel.

Implementations of a detachable system may include a main panel including a one or more openable windows therein, and a door stop coupled along a side of the main panel, where the door stop includes a deadbolt strike plate, a door latch strike plate, or both a deadbolt strike plate and a door latch strike plate. A deadbolt coupling system may be included, coupled on a side of the main panel opposing the side of the main panel to which the door stop is coupled. The deadbolt coupling system may include a deadbolt bar coupled to a mounting plate. There may not be a pet door in the main panel.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and:

FIG. 9 is a front view of an implementation of a pet door system folder with the upper and lower panels folded in;

DESCRIPTION

This disclosure, its aspects and implementations, are not limited to the specific components, assembly procedures or method elements disclosed herein. Many additional components, assembly procedures and/or method elements known in the art consistent with the intended pet door systems will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such pet door systems, and implementing components and methods, consistent with the intended operation and methods.

Figure 1:
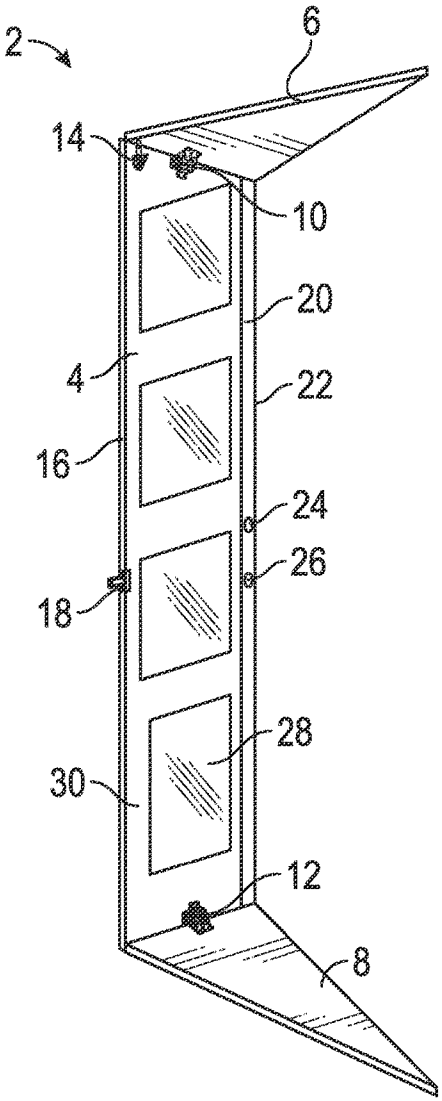
FIG. 1 is a front perspective view of an implementation of a pet door system.

Referring to FIG. 1, an implementation of a pet door system 2 is illustrated. Implementations of pet door systems like those disclosed in this document are designed to fit between a swinging door and a door casing in which the door is installed thereby allowing a pet door opening to be included. The system 2 includes a main panel 4 to which an upper panel 6 and lower panel 8 are hingedly coupled. In various implementations, hinges 10, 12 are used to hingedly couple the upper panel 6 and lower panel 8 with the main panel 4. As will be described hereafter, these hinges 10, 12 may be locking hinges in various implementations. Additional support for the upper panel 6 to keep it in an extended position away from the main panel 4 may be provided by a latch 14 which biases the upper panel 6 away from the main panel 4 until the latch 14 is released. In various implementations, as will be described hereafter, the latch 14 may be a toggle latch.

Along a first side 16 of the main panel 4 a deadbolt coupling system 18 is coupled. The deadbolt coupling system 18 is positioned along the main panel 4 so that a deadbolt bar of the system 18 can be inserted into a deadbolt strike plate mounted to the door casing. Generally, since the main panel 4 may be oriented substantially perpendicularly to a plane formed by the door casing itself, the deadbolt bar will corresponding be oriented substantially perpendicularly to a plane formed by the main panel 4. In other implementations, however, where the main panel 4 is designed to be coupled at an angle other than perpendicular to the plane of the door casing, the deadbolt bar will be oriented at a corresponding angle to the plane of the main panel 4. Because the deadbolt coupling system 18 is designed to couple with the deadbolt strike plate of the door casing, the main panel 4 can be coupled to the door casing at that location.

Along a second side 20 of the main panel 4 a door stop 22 is coupled. The door stop 22 illustrated in FIG. 1 includes a deadbolt strike plate 24 (and corresponding opening in the door stop to receive a deadbolt bar) and a door latch strike plate 26 (and a corresponding opening in the door stop 22 to receive the latch). In various implementations, however, the door stop 22 may include only a deadbolt strike plate 24 or a door latch strike plate 26. The deadbolt strike plate 24 and the door latch strike plate 26 allow a deadbolt and/or a door latch of a door hung in the door casing to be coupled to the door stop 22. In this way, the main panel 4 of the door is coupled to the door, between the door and the door casing. In other implementations, however, the door stop may not be used, and the strike plates may be included in the main panel 4 itself.

A pet door 28 is included in the main panel 4, sized and positioned to allow an animal to pass through the pet door 28. Any of a wide variety of pet doors 28 may be utilized in various implementations. Some of these may include a hinged flap/entry flap 30 that allows the animal to pass into and out of the pet door 28. An example of such a door that could be used in various implementations is that disclosed in the '645 Patent previously incorporated by reference.

Figure 2:
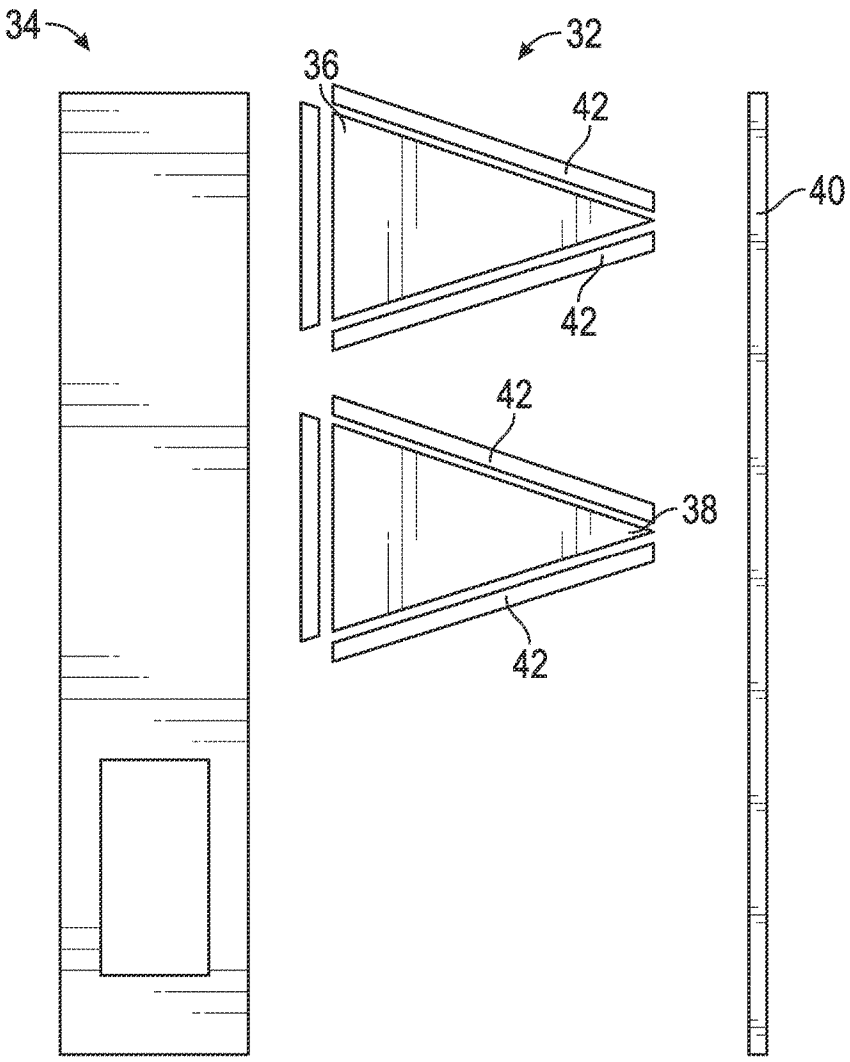
FIG. 2 is an exploded view of various components of an implementation of a pet door system.

Referring to FIG. 2, an exploded view of several components of an implementation of a pet door system 32 is illustrated. This view shows the outline of the main panel 34 and also shows how the upper panel 36 and lower panel 38 are triangularly shaped to fill in the space above and below the opening created by the door and main panel 34. The shape of the door stop 40 is also illustrated. Weather stripping 42 is included along the surfaces of the upper panel 36 and lower panel 38 where the panels meet the main panel 34 and meet the door and door casing to limit airflow, conserve energy, and/or prevent insects from entering at these locations.

Figure 3:
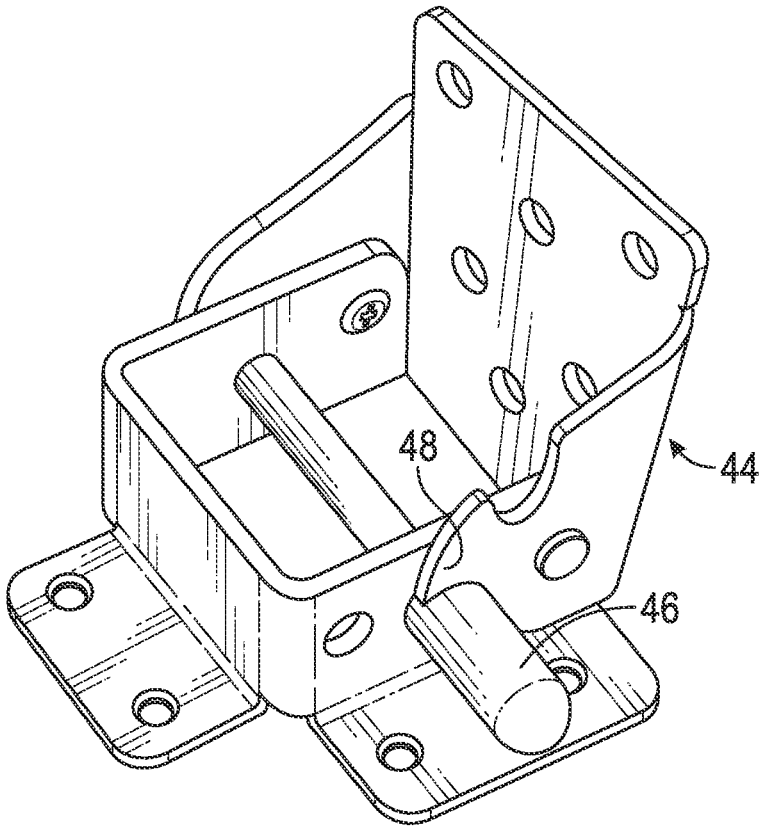
FIG. 3 is a perspective view of an implementation of a locking hinge.

Referring to FIG. 3, an implementation of a locking hinge 44 is illustrated. As illustrated, the locking hinge contains a locking pin 46 with a larger diameter on one end that is designed to engage a locking structure 48 on the hinge and prevent the locking structure 48 from moving across the pin 46. In this way, the locking hinge 44 is designed to keep the hinge in a fixed position while the locking pin 46 is engaged. This feature of the locking hinge 44 allows the upper panel and lower panel to be locked into a desired hinged relationship with the main panel when the pet door system is installed in a door opening.

Figure 4:
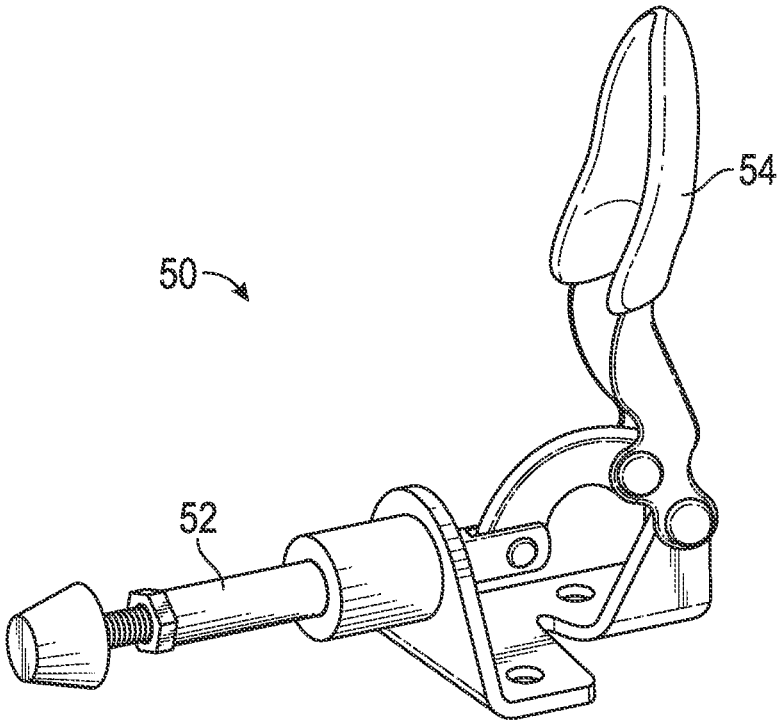
FIG. 4 is a perspective view of an implementation of a toggle latch.

Referring to FIG. 4, an implementation of a toggle latch 50 is illustrated. The toggle latch 50 includes a push rod 52 which is designed to move outwardly in response to movement of toggle 54. The push rod 52 is mechanically designed to remain in place against bias force applied against the rod until the toggle 54 is released. In this way, the toggle latch 50 can be used as a second support against the weight of the upper panel to prevent the upper panel from folding downwardly until both the locking hinge and toggle latch are released. This may improve the safety of the overall system.

Figure 5A:
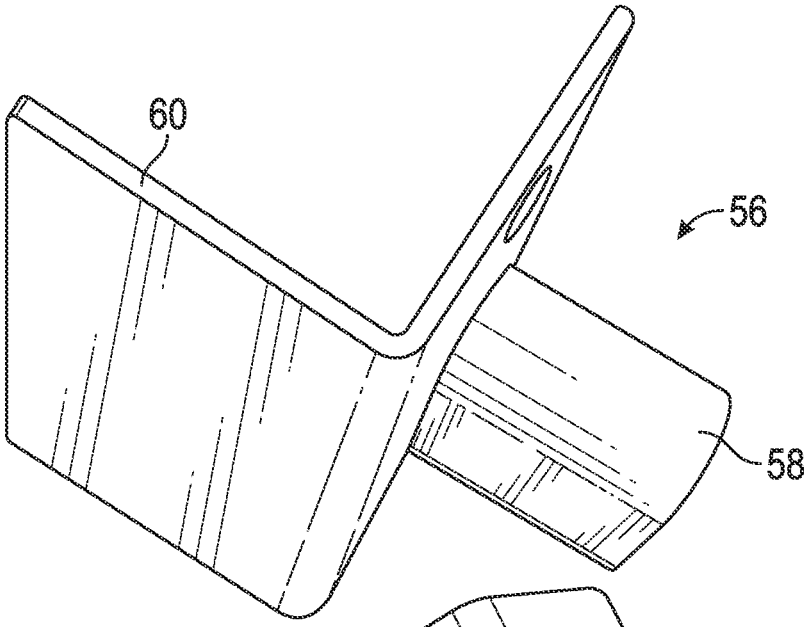
FIG. 5*a* is a side perspective view of a deadbolt coupling system.
Figure 5B:
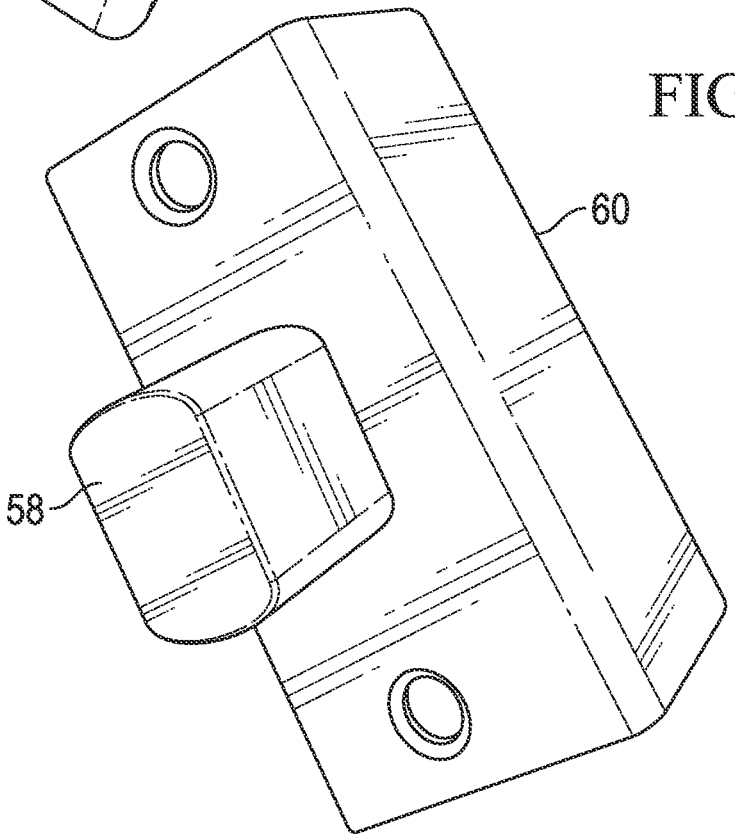
FIG. 5*b* is a front perspective view of a deadbolt coupling system.

Referring to FIG. 5, two views FIG. 5*a* and FIG. 5*b* of an implementation of a deadbolt coupling system 56 are illustrated. As can be seen, the system 56 includes a deadbolt bar 58 coupled to a mounting plate 60. The deadbolt bar 58 in this implementation may be, by non-limiting example, fixedly coupled to the mounting plate 60 through a fastener such as a screw, bolt, etc.; be fixedly coupled through welding or soldering; or may be integrally formed with the mounting plate through casting or molding. The mounting plate 60 is designed to fasten to the main panel along an edge of the main panel. Because the mounting plate is designed to fasten around the edge, the deadbolt bar 58 can be oriented substantially perpendicularly to the main panel and located so it fits into the deadbolt strike plate of the door casing. In this way, the deadbolt coupling system 56 allows the main panel to couple to the door casing through the deadbolt bar 58. The deadbolt bar 58 and mounting plate 60 may be formed of various materials including metals and composites and may be sized as appropriate to assist with preventing cutting of the deadbolt bar 58. In various implementations, the deadbolt bar may include an additional bar internally that rotates when contacted by a saw attempting to cut through the deadbolt bar, thereby preventing the deadbolt bar from being sawn through.

Figure 6:
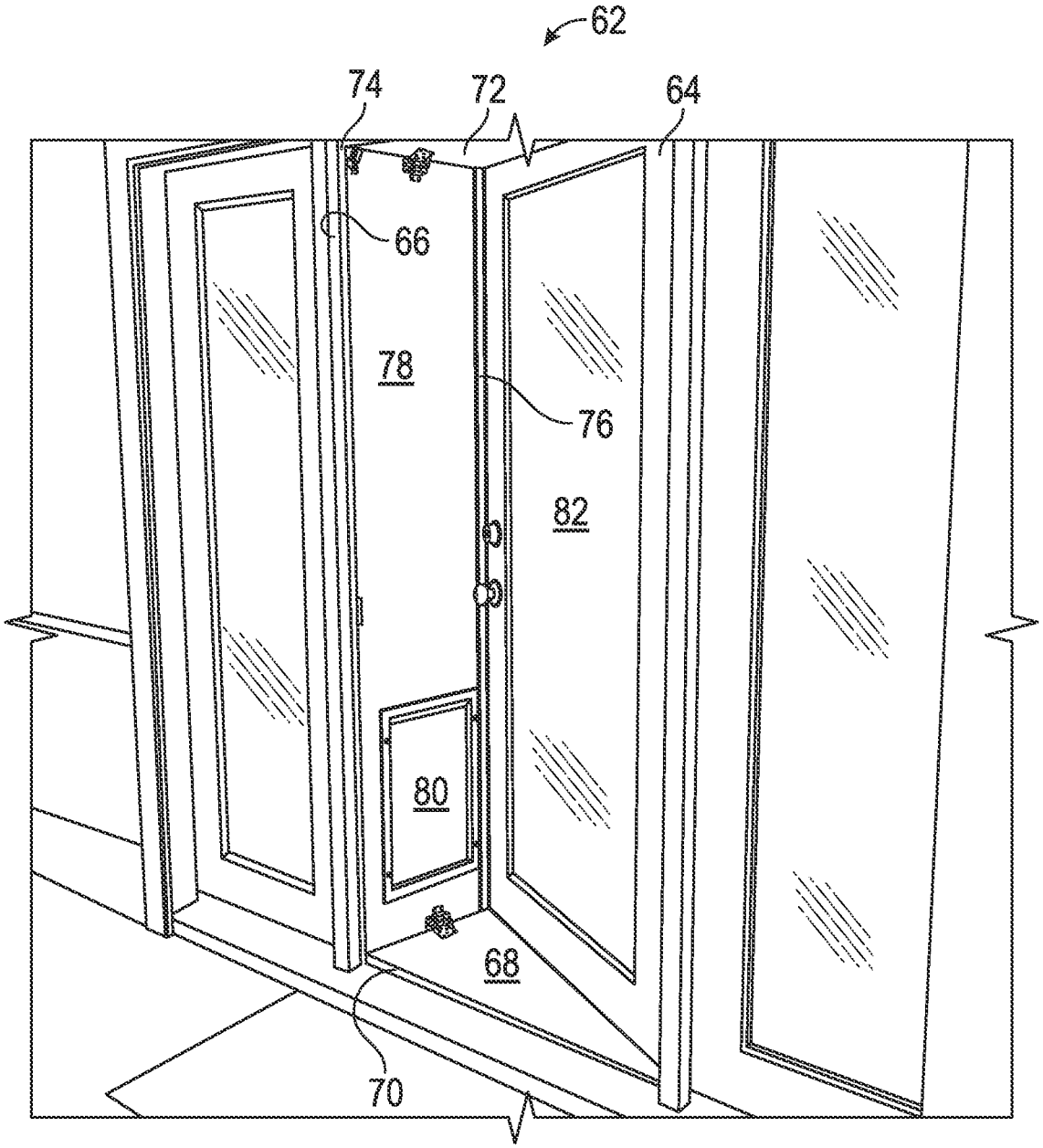
FIG. 6 is a front perspective view of an implementation of a pet door system installed in an inswing patio door.

Referring to FIG. 6, a front view of an implementation of a pet door system 62 is illustrated installed in an opening created by an inswing door 64 and a door casing 66. As illustrated, the lower panel 68 fills in the space between the door 64 and the door sill 70 and the upper panel 72 fills in the space between the door 64 and the upper edge 74 of the casing. The deadbolt and door latch of the door 64 are engaged with the corresponding strike plates in the door stop 76, and the main panel 78 is coupled with the door casing at the deadbolt strike plate of the door casing. The pet door 80 of the main panel 78 now allows an animal, such as a dog or cat, to enter freely through the pet door 80. While the door 64 illustrated in FIG. 6 is an inswing door, system implementations may be created that can be used with outswing doors using the principles disclosed herein. Also the systems illustrated herein may be able to be used without modification for both left hung and right hung doors. The door 64 includes a single glass pane 82, which prevents the cutting of an opening for fitting a conventional pet door therein. Because of this, pet door systems disclosed herein can be used with door types that traditionally cannot be modified to include pet doors, such as glass pane and French doors.

Figure 7:
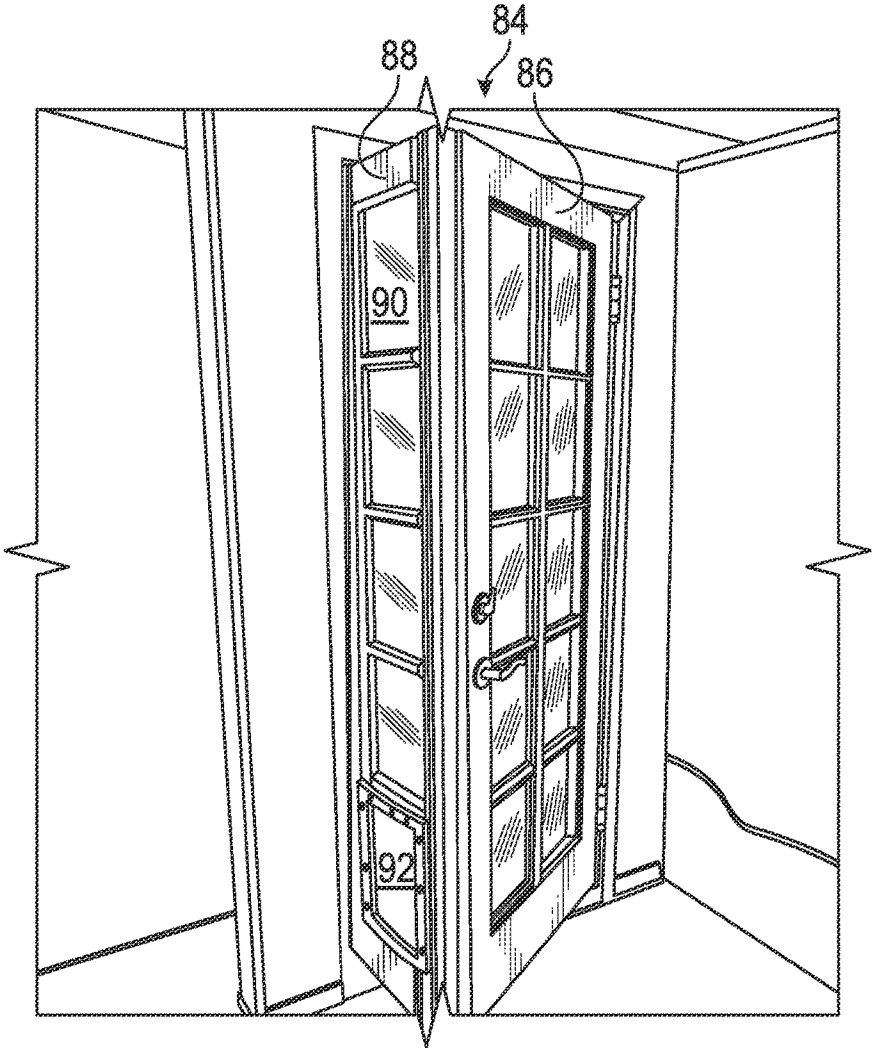
FIG. 7 is a rear perspective view of another implementation of a pet door system installed in an inswing French door.

Referring to FIG. 7, a back view of an implementation of a pet door system 84 installed in an opening with a French inswing door 86 is illustrated. As illustrated, the main panel 88 includes glass window panes 90 that correspond in size with those of the French door 86. In various implementations, the finish of the main panel 88 can be done to correspond with the finish of the French door as well, to make them appear as though they are a single unit. In this way, a pet door 92 can be created in a doorway that includes a French door, which otherwise would have been impossible to have been modified in order to fit a conventional pet door.

Figure 8:
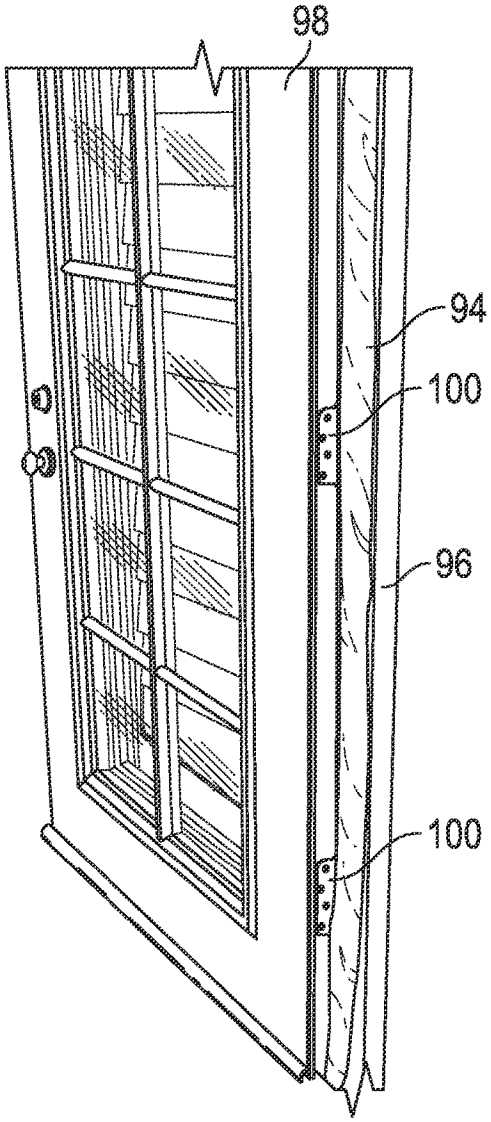
FIG. 8 is a front perspective view of an implementation of a door sock installed along the hinges of an inswing French door.

Referring to FIG. 8, an implementation of a door sock 94 is illustrated, positioned in the opening between the door casing 96 and the door 98 created by the door hinges 100 as the door 98 is swung open. The door sock 94 is designed to fill the space of the opening, and block light and air from passing through the opening. This may improve the energy efficiency and/or prevent insects from entering through opening while the pet door system installed in the door. The door sock 94 may include a flexible material within a casing material, such as, by non-limiting example, a fabric batting, fiberglass insulation, open or closed cell foam, or any other flexible material capable of being compressed. The casing may be waterproofed or otherwise UV resistant to prevent the door sock from breaking down as a result of exposure to the elements.

Figure 9:
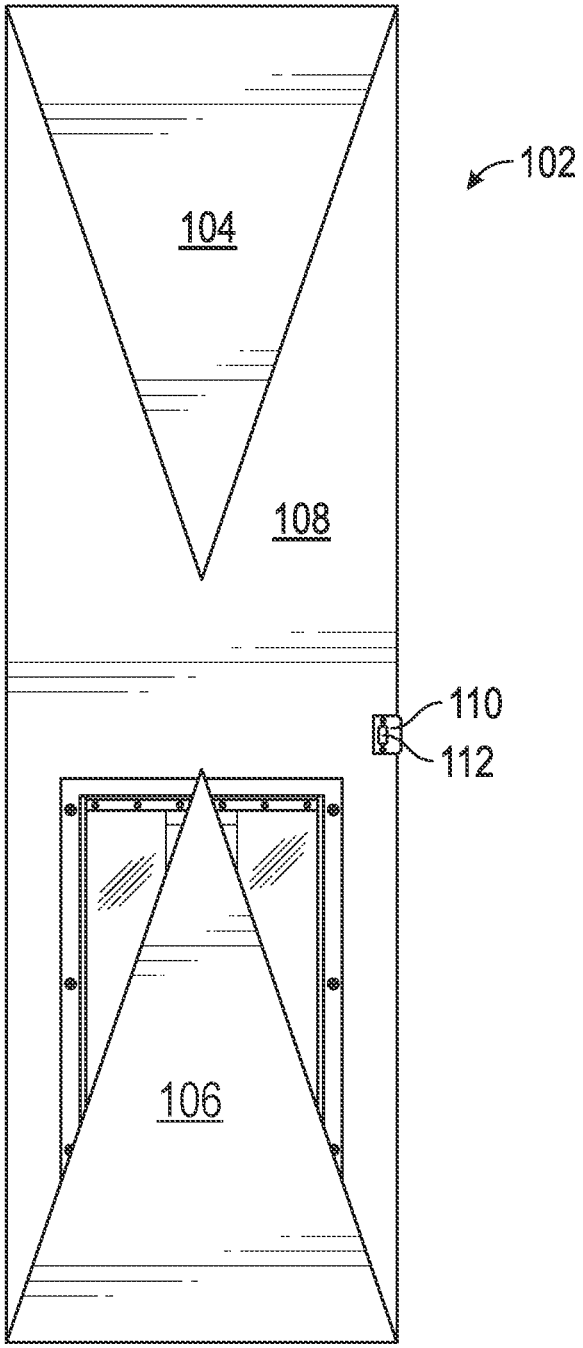
Figure 10:
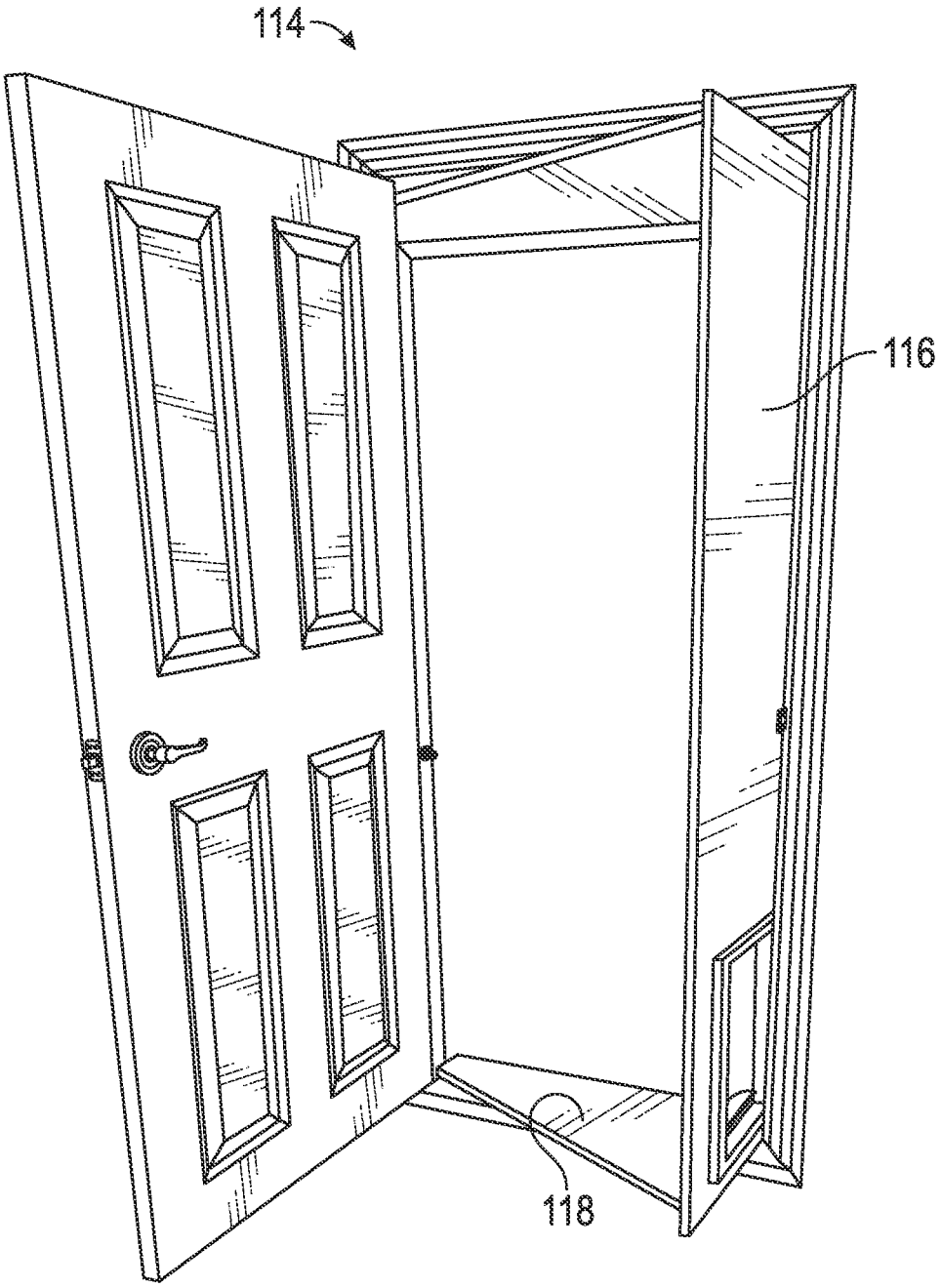
FIG. 10 is a rear perspective view of an implementation of a pet door system with an inswing door opened and not coupled at the strike plate of the main panel.

Referring to FIG. 9, a front view of an implementation of a pet door system 102 is illustrated in a folded position. In this position, the upper panel 104 and lower panel 106 are folded down and up, respectively against the main panel 108. The door latch strike plate 110 is visible with the latch opening therein 112 facing directly out of the paper. In the folded position, the system 102 may be stored more easily against a wall, in a garage, etc. when the pet door is not needed. Implementations of pet door systems like those disclosed herein are generally designed to be temporarily installed in to door openings. However, users could choose to place system implementations semi-permanently or permanently in the door openings, since the doors are still usable (openable and closable) while the pet door system is installed in the door opening. FIG. 10 illustrates this, showing a back view of an implementation of a pet door system 114 with the door opened and disengaged from the strike plate(s) of the door stop/main panel 116. As can be seen, it is possible for a user to still enter and exit through the door even when the pet door system 114 is installed, by stepping over the lower panel 118.

The materials from which implementations of main panels, top panels, bottom panels, and pet doors may be made may include, by non-limiting example, wood, metal, fiberglass, composite materials, plastics, rubbers and the like. Those of ordinary skill in the art will readily be able to select appropriate materials for these components using the principles disclosed herein.

Figure 11:
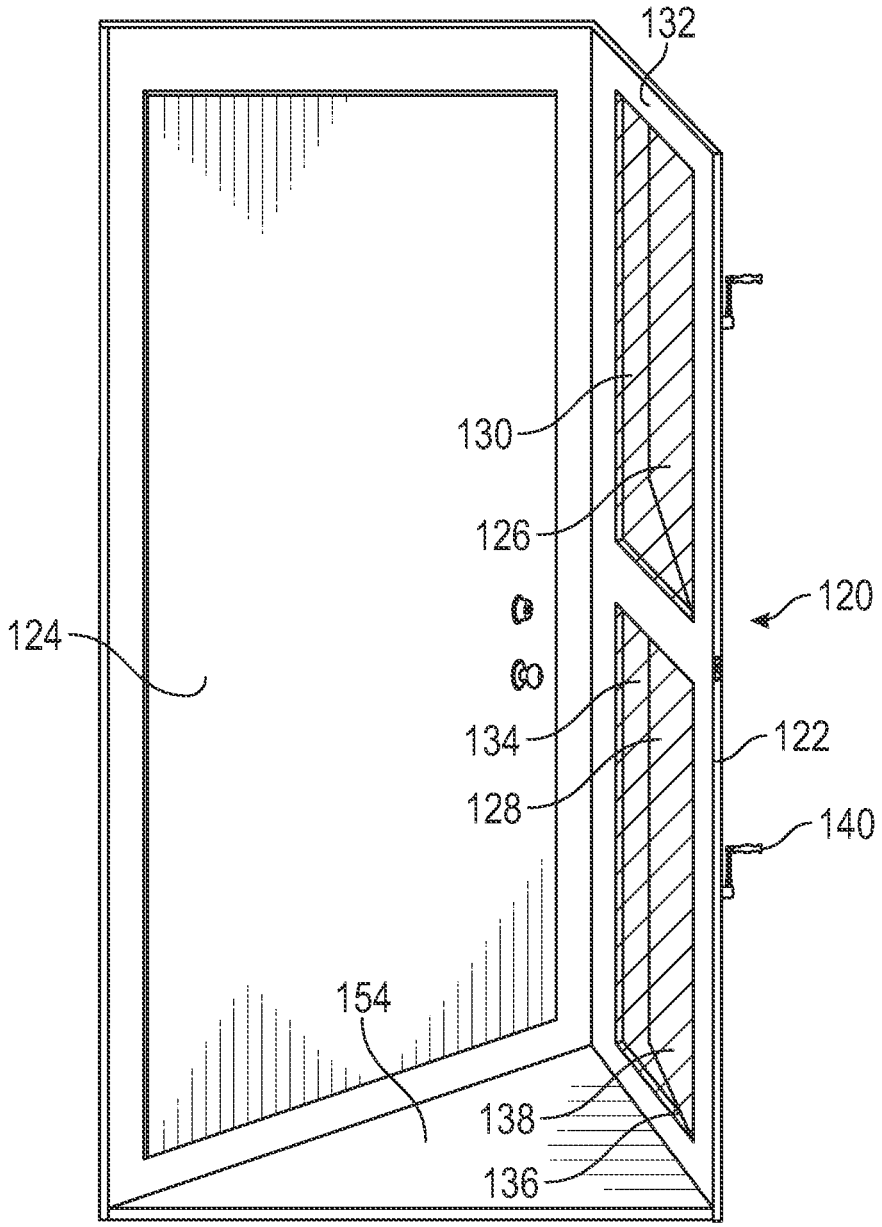
FIG. 11 is a front perspective view of an implementation of a detachable window system with an outward swing door.

Referring to FIG. 11, an implementation of a detachable window system 120 is illustrated. The implementation of the detachable window system 120 is coupled with the door casing 122 of an outward swinging door 124. Referring to FIG. 11, the implementation of a detachable window system 120 includes two windows 126 and 128. There is an openable window 126 in the top portion 130 of the main panel 132 and an openable window 128 in the bottom portion 134 of the main panel. Each of the two openable windows 126 and 128 illustrated includes a window casing 136, a screen 138 within the window casing 136, and a window opening mechanism 140. In some implementations, the window opening mechanism may be a crank. In other implementations, the window opening mechanisms may include levers, tracks, and other mechanisms for opening the windows.

As illustrated in FIG. 11, the windows open out at an angle from the detachable window system. In other implementations, the one or more openable windows may include one or more sashes that slide to open and do not require more space to open the window. In some implementations, the panes in the openable windows may be glass and in other implementations, the panes may be formed of other transparent/translucent material such as, by non-limiting example, plastic.

Figure 12:
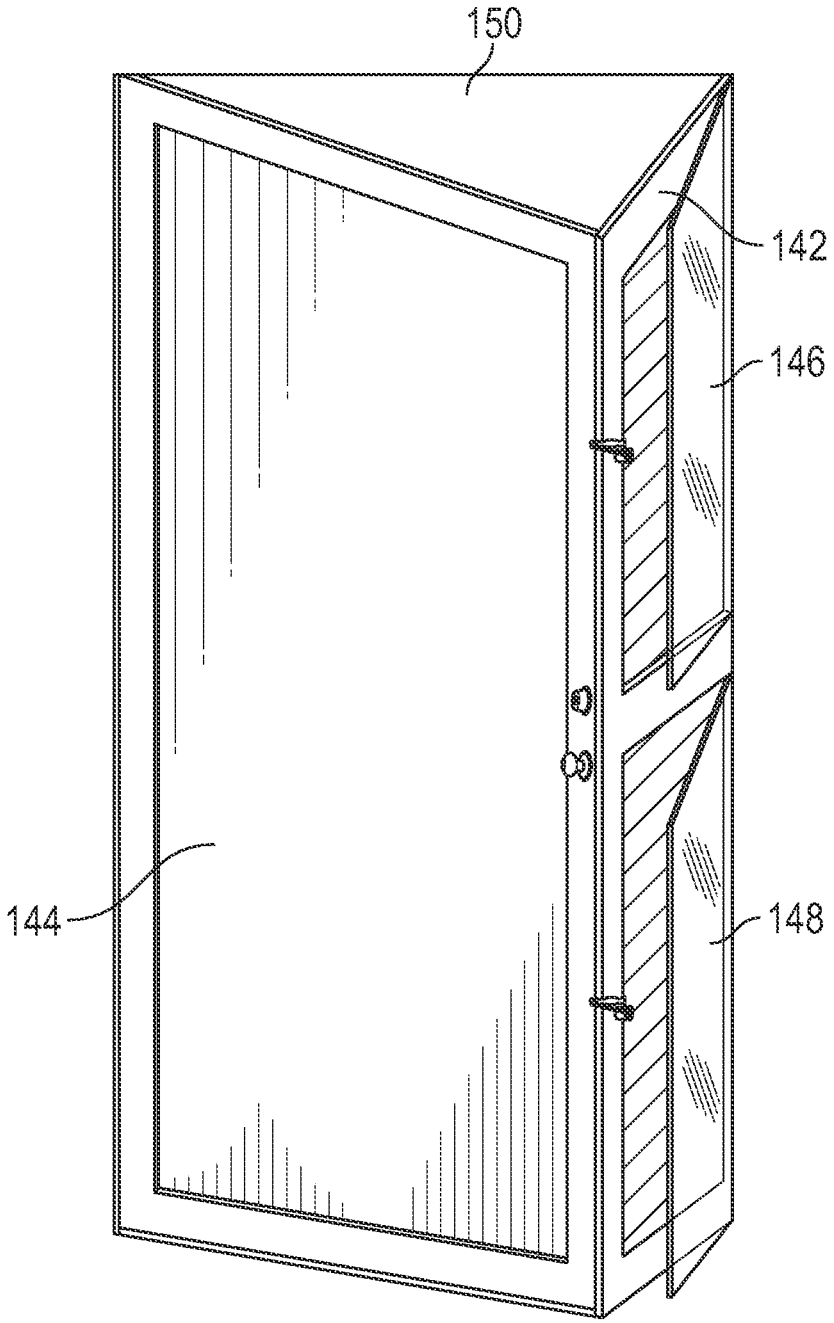
FIG. 12 is a front perspective view of an implementation of a detachable window system with an inswing door.
Figure 13:
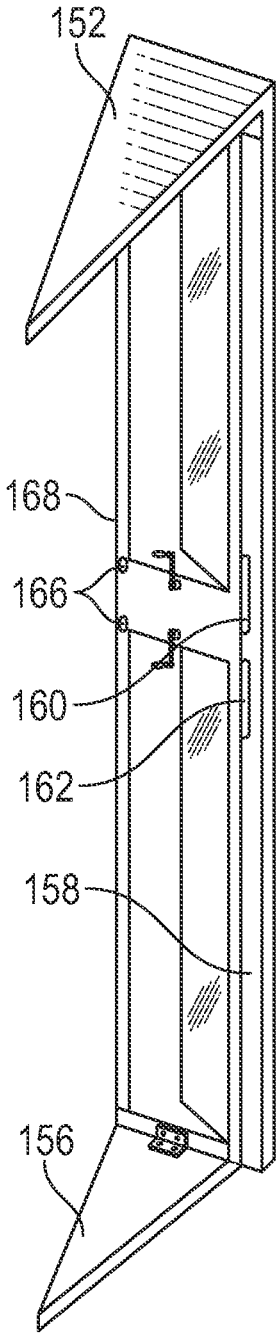
FIG. 13 is an side perspective view of an implementation of a detachable window system.

Referring to FIG. 12, the detachable window system 142 may be coupled to an inward swing door 144 as illustrated in FIG. 12. The detachable window system 142 includes a main panel having two openable windows 146 and 148. In various implementations, there may be only one openable window and the one openable window may take up only a portion of the main panel. The detachable window system 142 also includes an upper panel 150 and 152 hingedly coupled to an upper side of the panel as illustrated in FIG. 12 and FIG. 13, respectively. The detachable window system also includes a lower panel 154 and 156 hingedly coupled to a lower side of the main panel opposing the upper side as illustrated in FIGS. 11 and 13, respectively. The upper panel and lower panels may help to seal the opening caused by a door being in an opened position. The upper panel and the lower panel may fold onto the main panel for storage.

Figure 14:
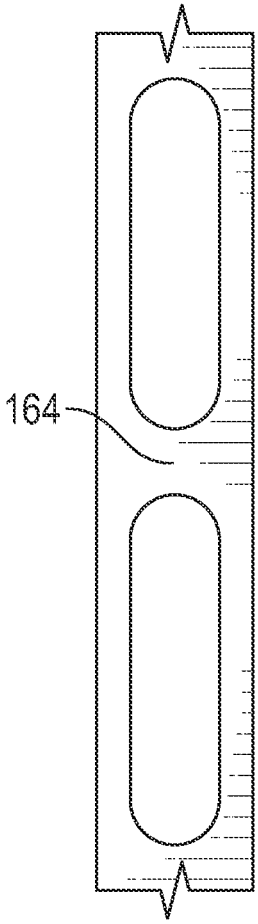
FIG. 14 is an enlarged view of an implementation of a strike plate in an implementation of a detachable window system as shown in FIG. 13.

Referring to FIG. 13, implementations of a detachable window also include a door stop 158 coupled along a side of the main panel. The door stop 158 includes a deadbolt strike plate and a door latch strike plate. An enlarged view of a combination 164 deadbolt strike plate 160 and a door latch strike plate 162 is illustrated in FIG. 14. In various implementations, the door stop may have only a deadbolt strike plate or only a door latch strike plate depending on the door casing of the original door. The original door may be a standard front or rear entry door in various implementations. Implementations of a detachable window system may be used in houses, apartments, dorm rooms, and other situations where a user may not be able to add a permanent window and/or screen door to their dwelling (particularly where the user is a renter of the property). The ability of implementations of a detachable window to be used on an inswing door may allow users to install the system without the system protruding into a hallway of an apartment building or dormitory/residence hall. In other implementations, the original door may be coupled to French doors at the back of a dwelling as previously described in this document.

Figure 15:
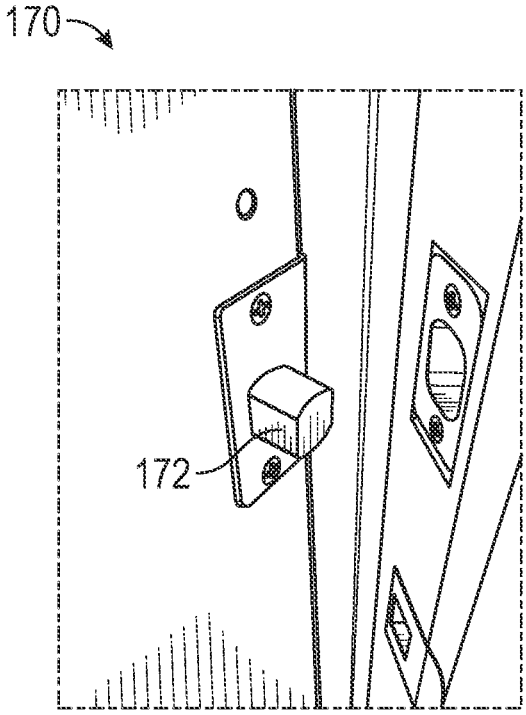
FIG. 15 is an enlarged view of an implementation of a deadbolt coupling system on an implementation of a detachable window system.

Referring again to FIG. 13, implementations of a detachable window system also include deadbolt coupling system 166 on a side 168 of the main panel opposing the side of the main panel to which the door stop 158 is coupled. An enlarged view of the deadbolt coupling system 170 is illustrated in FIG. 15. The deadbolt coupling system 170 includes a deadbolt bar 172 coupled to a mounting plate. The deadbolt coupling system allows the detachable window system to fully engage with the door and casing where it is installed.

Figure 16:
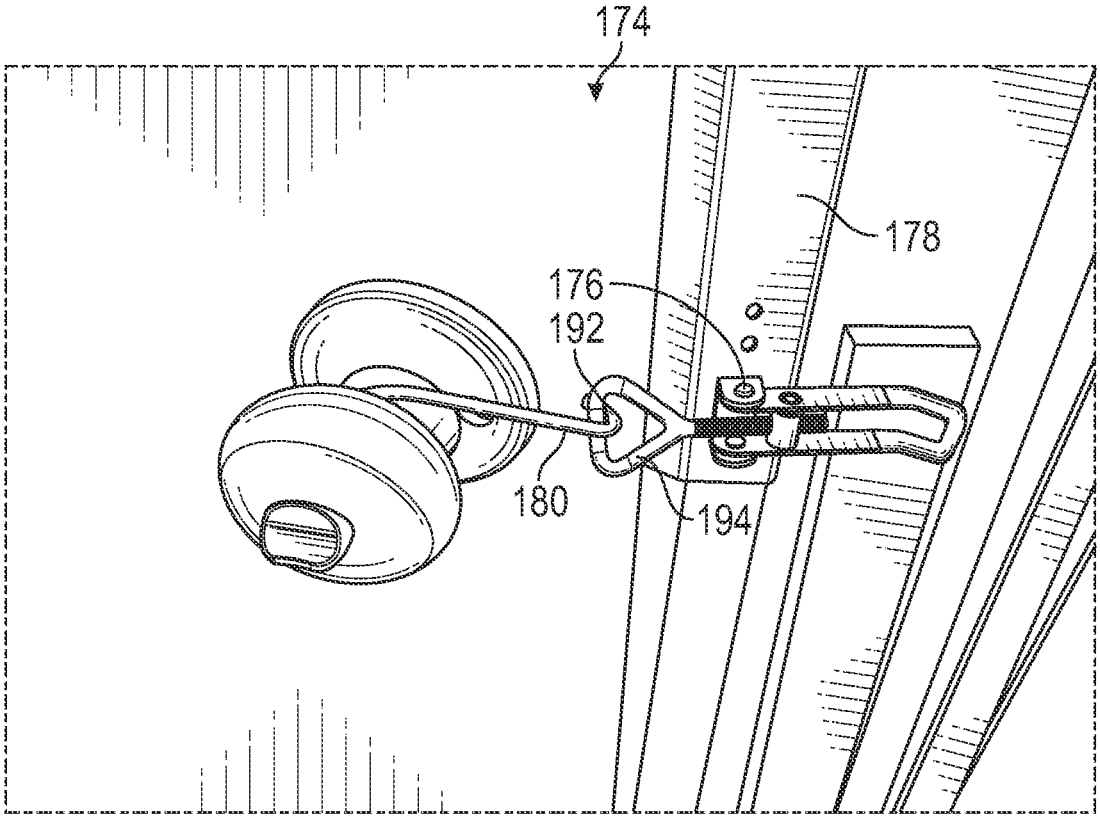
FIG. 16 is a front perspective view of an implementation of a locking system in a locked position.
Figure 17:
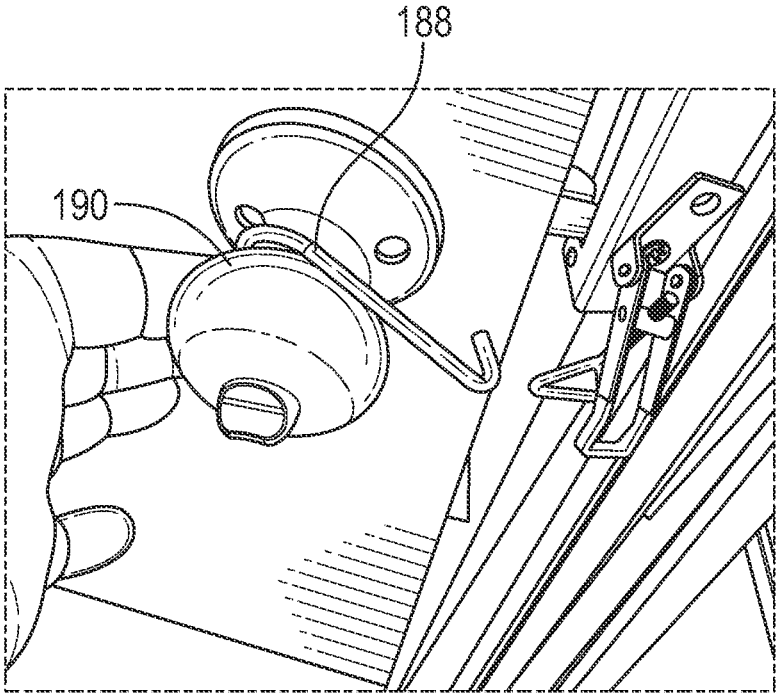
FIG. 17 is a top perspective view of an implementation of a locking system in an unlocked position.
Figure 18:
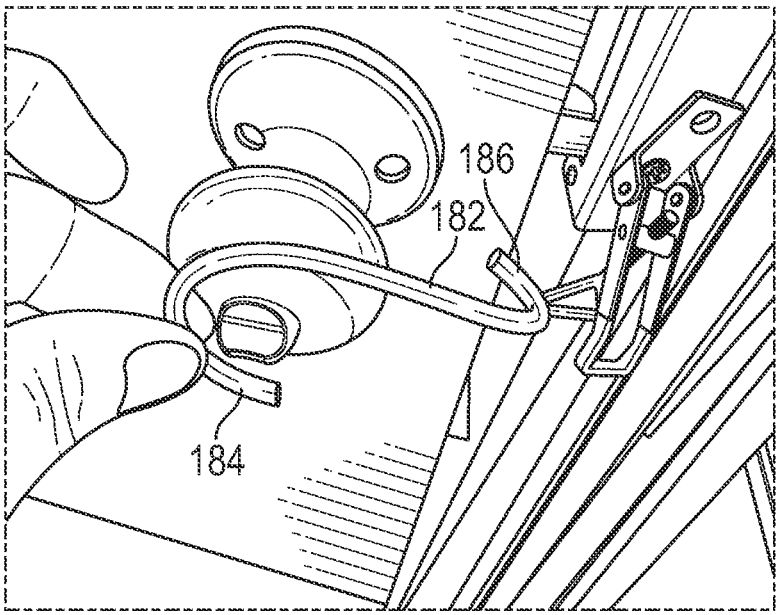
FIG. 18 is a top perspective view of an implementation of a hook from an implementation of a locking system.

Referring to FIG. 16, an implementation of a locking system 174 for an implementation is illustrated. The locking system 174 includes a toggle latch 176 coupled along a side of a main panel 178 of a detachable window system. In various implementations a locking system may be used with a standard door to provide extra security to a user. The locking system also includes a hook 180. As illustrated in FIG. 18, an implementation of a hook 182 used in a locking system has a first end 184 and a second end 186. The first end 184 of the hook and the second end 186 of the hook may have similar sizes or one end of the hook may be larger than the other end of the hook. By non-limiting example, the first end of the hook may be larger than the second end of the hook or the second end of the hook may be larger than the first end of the hook. In various implementations, the first end of the hook 188 may be large enough to fit around the smallest end of a door knob coupled to a door as illustrated in FIG. 17. Referring again to FIG. 16, the second end 192 of the hook 180 may couple with a ring 194 extending from the toggle latch 176. The toggle latch may be placed in a closed position to put tension on the hook when the latch is closed/rotated thereby locking the door and detachable window system from the inside and preventing the door from being opened.

In places where the description above refers to particular implementations of pet door systems and implementing components, sub-components, methods and sub-methods, it should be readily apparent that a number of modifications may be made without departing from the spirit thereof and that these implementations, implementing components, sub-components, methods and sub-methods may be applied to other pet door systems.

What is claimed is:

1. A detachable window system comprising:

a main panel comprising one or more openings therein and one or more optically transmissive panels pivotally movable about a vertical axis between open and closed positions and adapted to extend over the one or more openings when in the closed position;

an upper panel hingedly coupled to an upper side of the main panel;

a lower panel hingedly coupled to a lower side of the main panel opposing the upper side;

a door stop coupled to a lateral side of the main panel, the door stop comprising a deadbolt strike plate, a door latch strike plate, or both the deadbolt strike plate and the door latch strike plate; and a deadbolt coupling system coupled to a lateral side of the main panel opposing the lateral side of the main panel to which the door stop is coupled, the deadbolt coupling system comprising a deadbolt bar coupled to a mounting plate, the deadbolt bar configured to couple to an opening in a deadbolt strike plate coupled to a door jamb securing the main panel to the door jamb.

2. The system of claim 1, wherein the upper panel is hingedly coupled to the main panel through a locking hinge and the lower panel is hingedly coupled to the main panel through a locking hinge.

3. The system of claim 1, wherein the upper panel is biased upwardly by a toggle latch coupled to the main panel.

4. The system of claim 1, further comprising one or more window casings, one or more screens, and one or more window opening mechanisms adapted to move the one or more optically transmissive panels between the open and closed positions.

5. The system of claim 4, wherein the one or more window opening mechanisms is used to move the one or more optically transmissive panels to the open position to permit air to flow through the one or more screens.

6. A detachable window system comprising:

a main panel comprising one or more windows disposed therein;

an upper panel hingedly coupled to an upper side of the main panel;

a lower panel hingedly coupled to a lower side of the main panel opposing the upper side;

a door stop coupled to a lateral side of the main panel, the door stop comprising at least a door latch strike plate; and a deadbolt coupling system coupled to a lateral side of the main panel opposing the lateral side of the main panel to which the door stop is coupled, the deadbolt coupling system comprising a deadbolt bar non-movably fixed to a mounting plate non-movably fixed to the main panel, the deadbolt bar configured to be received within a deadbolt strike plate opening of a door jamb securing the main panel to the door jamb.

7. The system of claim 6, wherein the upper panel is hingedly coupled to the main panel through a locking hinge and the lower panel is hingedly coupled to the main panel through a locking hinge.

8. The system of claim 6, wherein the upper panel is biased upwardly by a toggle latch coupled to the main panel.

9. The system of claim 6, wherein the one or more windows comprise one or more window casings, one or more screens, and one or more window opening mechanisms.

10. The system of claim 9, wherein the one or more window opening mechanisms is used to open the one or more windows to permit air to flow through the one or more screens.

* * * * *